US007007742B2

(12) United States Patent
Desjardins

(10) Patent No.: US 7,007,742 B2
(45) Date of Patent: Mar. 7, 2006

(54) METHOD AND SYSTEM FOR PRE-HEATING WATER

(76) Inventor: Marc Desjardins, Box 72036, North Postal Outlet, Kanata Ontario K2K 2P4 (CA)

( * ) Notice: Subject to any disclaimer, the term of this patent is extended or adjusted under 35 U.S.C. 154(b) by 204 days.

(21) Appl. No.: 10/142,526

(22) Filed: May 10, 2002

(65) Prior Publication Data

US 2002/0174973 A1 Nov. 28, 2002

(30) Foreign Application Priority Data

May 23, 2001 (CA) ..... 2348208

(51) Int. Cl.
*F24H 3/00* (2006.01)

(52) U.S. Cl. ..... 165/47; 122/18.2; 126/101

(58) Field of Classification Search ..... 165/909, 165/47, 901; 122/20 B, 421, 18.1, 18.2; 126/101
See application file for complete search history.

(56) References Cited

U.S. PATENT DOCUMENTS 1,849,266 A 3/1932 Bentz
3,645,251 A * 2/1972 Black ..... 126/359.1
4,175,518 A * 11/1979 Reames, Jr. ..... 122/20 B
4,242,872 A * 1/1981 Shaw ..... 62/235.1
4,275,687 A * 6/1981 Sasaki ..... 122/20 B
4,338,888 A * 7/1982 Gerstmann et al. ..... 122/18.4
4,353,353 A * 10/1982 Keller ..... 126/630
4,378,787 A * 4/1983 Fleischmann ..... 126/589
4,484,564 A * 11/1984 Erickson ..... 126/365.1
4,503,839 A * 3/1985 Dunstan ..... 126/563
4,517,958 A * 5/1985 Worf ..... 126/630
4,604,991 A * 8/1986 Miller ..... 126/619
4,653,434 A 3/1987 Wilhelm, Jr.
4,671,253 A * 6/1987 Blount, Sr. ..... 126/640
4,702,226 A * 10/1987 Shelley ..... 122/18.2
5,014,770 A * 5/1991 Palmer ..... 165/48.2
5,304,286 A * 4/1994 Palmer ..... 202/167

(Continued)

FOREIGN PATENT DOCUMENTS

CA 2188321 A1 4/1997

*Primary Examiner*—Terrell Mckinnon
(74) *Attorney, Agent, or Firm*—Pearne & Gordon LLP

(57) ABSTRACT

A system and method for pre-heating water prior to entering a hot water heater is disclosed. The system includes: a cold water supply line; an ambient air heat exchange device positioned within an insulated area of a building wherein the ambient air heat exchange device is connected to the cold water supply line; and a fluid connected for interconnecting the ambient air heat exchanged device to the hot water heater, the ambient air heat exchange device being operable to: allow incoming cold water to enter the ambient air heat exchange device as required; permit the transfer of heat from ambient air within the insulated area to the cold water within the ambient air heat exchange device to effect pre-heating thereof; and pass water, as thus preheated, from the ambient air heat exchange device to the hot water heater as required. The ambient air heat exchange device may comprise a reservoir or a heat exchanger having at least one pipe. By utilizing energy stored within an insulated area to pre-heat incoming cold water, a reduction in hot water heating costs can be realized. Also disclosed is a method for pre-heating water in an insulated building prior to entering a hot water heater. Also disclosed is a pre-heater for pre-heating water prior to entering a hot water heater.

5 Claims, 3 Drawing Sheets

U.S. PATENT DOCUMENTS 5,878,588 A * 3/1999 Biancardi ..... 62/177
6,564,755 B1 * 5/2003 Whelan ..... 122/20 B
6,612,267 B1 * 9/2003 West ..... 122/13.3
6,619,951 B1 * 9/2003 Bodnar et al. ..... 431/329

* cited by examiner

METHOD AND SYSTEM FOR PRE-HEATING WATER

FIELD OF THE INVENTION

The present invention generally relates to heat exchangers. More specifically the present invention relates to a method and system for pre-heating water prior to entering a hot water heater.

BACKGROUND OF THE INVENTION

Hot water heaters are well known devices for heating cold water. These devices typically consist of an insulated tank which stores cold water to be heated. The water is typically heated electrically or by combusting gas at the base of the tank and allowing the exhaust to flow up through the a series of internal pipes and out an exhaust port. The cold water within the tank is heated either as a result of being in contact with the electrical coil or the internal pipes which carry the combusted gasses. The major drawback of such hot water heating systems, however, is the excessive operating costs.

One way to reduce the operating costs of a hot water heating system is to increase the efficiency of the system. In thermodynamics terms, efficiency is the ratio of useful energy output by a system compared to the total energy input to the system. The efficiency of a hot water heating system, therefore, is effectively the ratio of the temperature increase of the water therein, compared to the fuel energy spent to achieve that increase. Thus, assuming the volume of water remains constant, an improvement in the efficiency of a hot water heating system will result in a reduction in the amount of energy required to heat the water to a given temperature. This is because the system will require less energy to produce the same result as compared to a less efficient system.

Alternatively, one can improve the operating costs of a hot water heating system by utilizing a cost free energy source. In this scenario the efficiency of the hot water heating system remains unchanged, as the system itself is unchanged. As a result of using a cost free energy source, however, one reduces the total amount of energy required to heat the water. As a result, a reduction in operating costs also occurs.

Several prior art attempts have been made to reduce operating costs of hot water heating systems by improving efficiency. Typically, these prior art systems recycle energy produced for the purpose of heating the water therein. Such increases in efficiency are typically achieved through the use of a pre-heating device often referred to as a pre-heater.

One example of a hot water pre-heating device is a flue exhaust pre-heater. In order to pre-heat incoming cold water, flue exhaust pre-heaters utilize heated gasses exhausted from the hot water heating process. The pre-heating of the water is achieved by directing the flow of exhaust fumes across the incoming cold water pipes, prior to entry of these pipes into the hot water tank. Thus, by utilizing energy that is otherwise lost to atmosphere, the efficiency of the hot water heating system may be increased. This is because the amount of energy required to produce the desired result may be reduced. An example of such a pre-heater is shown in U.S. Pat. No. 4,175,518 to Reames, Jr. The major drawback of such a system, however, is the complex modifications that must be made to one's existing heating system, to utilize the pre-heater. For example, one must not only modify the existing exhaust means of the hot water heater, but also the cold water delivery pipes. With respect to the cold water pipes, this may be an onerous task as the pipes are often wound into a coil or other complex shape which maximizes heat transfer. Furthermore, such a device cannot be used in an electrical hot water heating system, as the pre-heater described above is reliant on heated exhaust for operation.

Other prior art pre-heaters recycle exhaust fumes from other sources as an attempt to reduce the operating costs of a hot water heating system. For example, U.S. Pat. No. 4,484,564 to Erickson discloses a system wherein the exhaust from one's chimney is used to pre-heat incoming cold water. The pre-heating which occurs in this system is the result of placing the cold water delivery pipes within a residential chimney. Similar to the flue-exhaust pre-heater, however, use of this system requires complex modifications to one's pre-existing hot water heating system. Furthermore, as will be apparent to one skilled in the art, modifications to one's chimney would also be required.

A third example of a pre-heating device which attempts to reduce the operating costs of a hot water heating system is disclosed in U.S. Pat. No. 4,671,253 to Blount Sr. The apparatus disclosed therein includes a system of piping which directs the flow of incoming cold water through the attic of a residence prior to entering a hot water heater. Similar to the chimney exhaust pre-heater described above, this system may increase the overall heating efficiency of a building (heating water and air) by recycling otherwise wasted energy i.e. heat energy trapped in one's attic. Again, this would be dependent upon the increase in total efficiency when compared to the efficiency of heating water and air alone. If, however, the additional energy is provided from a cost free source (eg. climate), a reduction in the total heating costs may be realized. The system described in Blount Sr., however, has at least two major disadvantages. First, similar to the aforementioned pre-heating devices, this system requires extensive modification to one's existing hot water system. These modifications include, among other things, constructing a complex system of piping to divert cold water through one's attic. As will be apparent to one skilled in the art, such modifications may also require additional pumping means, depending on the location of one's hot water heater, in order to overcome any potential energy increase associated with increasing the elevation of the water. Second, as attics are typically uninsulated, such a system is effective during warm seasons only. Furthermore, the system's pipes are prone to breakage by freezing due to exposure of the pipes to cold air in the attic. In that respect, multiple valves are necessary, and are in fact required in the system described in Blount, Sr., to divert the water away from the heat exchanger in winter months. Thus, the effectiveness of this device is limited and largely climate dependant.

A need exists, therefore, for an improved method and system of pre-heating water for hot water heaters.

SUMMARY OF THE INVENTION

It is, therefore, an object of the invention to provide a method and system for pre-heating water.

One aspect of the invention is defined as a method of pre-heating water prior to entering a hot water heater comprising the steps of: providing an ambient air heat exchange device within an insulated area of a building; allowing incoming cold water to enter the ambient air heat exchange device as required; permitting the transfer of heat from ambient air within the insulated area to the cold water within the ambient air heat exchange device to effect the pre-heating thereof; and passing water, as thus pre-heated, from the ambient air heat exchange device to the hot water heater as required.

Another aspect of the invention is defined as a system for pre-heating water prior to entering a hot water heater comprising: a cold water supply line; an ambient air heat exchange device positioned within an insulated area of a building wherein the ambient air heat exchange device is connected to the cold water supply line; and a fluid connector for interconnecting the ambient air heat exchange device to the hot water heater, the ambient air heat exchange device being operable to: allow incoming cold water to enter the ambient air heat exchange device as required; permit the transfer of heat from ambient air within the insulated area to the cold water within the ambient air heat exchange device to effect pre-heating thereof; and pass water, as thus pre-heated, from the ambient air heat exchange device to the hot water heater as required.

Various terms of art are used throughout this specification. A discussion of the various terms is set out hereinbelow in order to provide context to the meaning of each term.

The term "insulated area of a building" is used in connection with an area of a building which maintains ambient air therein at a temperature at or above the freezing point of water.

The term "cold water" is used in connection with water that has a lower temperature than ambient air within an insulated area of a building.

BRIEF DESCRIPTION OF THE DRAWINGS

These and other features of the invention will become more apparent from the following description in which reference is made to the appended drawings in which.

DETAILED DESCRIPTION OF THE INVENTION

The present invention is directed to a method and system for pre-heating water prior to entering a hot water heater.

Figure 1:
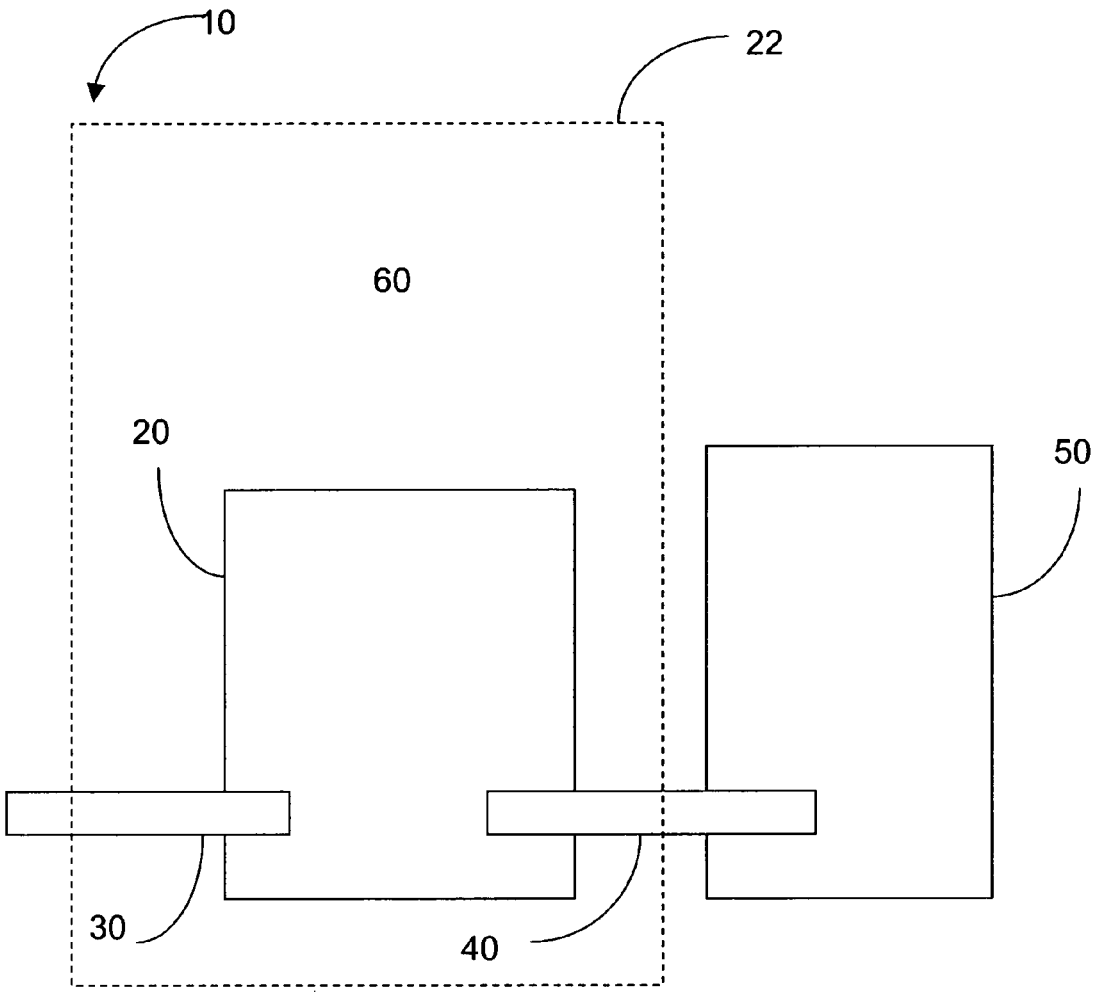
FIG. 1 presents a schematic representation of a system for pre-heating water prior to entering a hot water heater in accordance with an embodiment of the present invention.

A schematic representation of a system for pre-heating water prior to entering a hot water heater in accordance with an embodiment of the invention is shown in FIG. 1. The system is hereinafter referred to as a "pre-heater". As shown in FIG. 1, the pre-heater 10 consists of an ambient air heat exchange device 20 situated within an insulated area of a building 22. The pre-heater 10 also includes a cold water supply line 30 and a fluid connector 40 for interconnecting the ambient air heat exchange device 20 to a hot water heater 50.

In a preferred embodiment of the invention, the ambient air heat exchange device 20 is a reservoir. The reservoir exposes cold water stored therein, to ambient air 60 in a control volume defined by the insulated boundaries of a building 22. Thus, so long as the ambient air 60 is higher in temperature than the incoming cold water, heat transfer will occur.

One should note, however, that although the ambient air heat exchange device described in the preferred embodiment of the present invention is a reservoir, the invention is not limited in this manner. As will be apparent to one skilled in the art, the present invention will work equally well with any heat exchange device 20 capable of transferring heat from ambient air surrounding said device 60 to cold water therein. For example, the ambient air heat exchange device could include a pipe or series of pipes formed into any shape that maximizes the available surface area for heat exchange. For example such shapes could include a coil, a sinusoidal pattern or any combination thereof. To further increase the heat exchange capacity of an exchanger, one could also apply fins to the aforementioned pipes or reservoir. As will be apparent to one skilled in the art of heat exchange, attaching fins to a heat exchanger increases the surface area of the exchanger and consequently its effectiveness. Furthermore, one could use a combination air to liquid/liquid to water heat exchanger as an ambient air heat exchange device. In this case, energy from the ambient air would be exchanged with a secondary fluid via an air to liquid exchanger (as described above). Heat stored within that secondary fluid could then be transferred to the cold water via a liquid to water heat exchanger. Such a liquid to water heat exchanger could include any tube and shell exchanger as is well known in the art. As will be apparent to one skilled in the art, such a system would require pumping means to cause the secondary fluid to flow through the U two exchangers.

As will be apparent to one skilled in the art, the ambient air heat exchange device 20 should preferably be uninsulated. This is to ensure a maximum rate of heat transfer from the ambient air 60 to the incoming cold water. Notwithstanding this, one should note that the present invention will still function with an insulated heat exchange device. Any insulation would, however, reduce the rate of heat transfer in the system and, consequently, the effectiveness of the system.

In one embodiment, the ambient air heat exchange device 20 includes at least a baffle to facilitate mixing of colder incoming water with warmer water contained within the ambient air heat exchange device. This helps to avoid a situation where a flow of un-heated incoming water reaches the fluid connector 40 prior to mixing with heated water contained within the ambient air heat exchange device.

Although not shown in FIG. 1, one should also note that if the ambient air heat exchange device 20 is used on a water system which includes a pressure tank, the ambient air heat exchange device should be positioned downstream of the pressure tank. This is to avoid storing pre-heated water in the pressure tank which could be required for one's cold water supply. As would be apparent to one skilled in the art, this would be undesirable.

Figure 2:
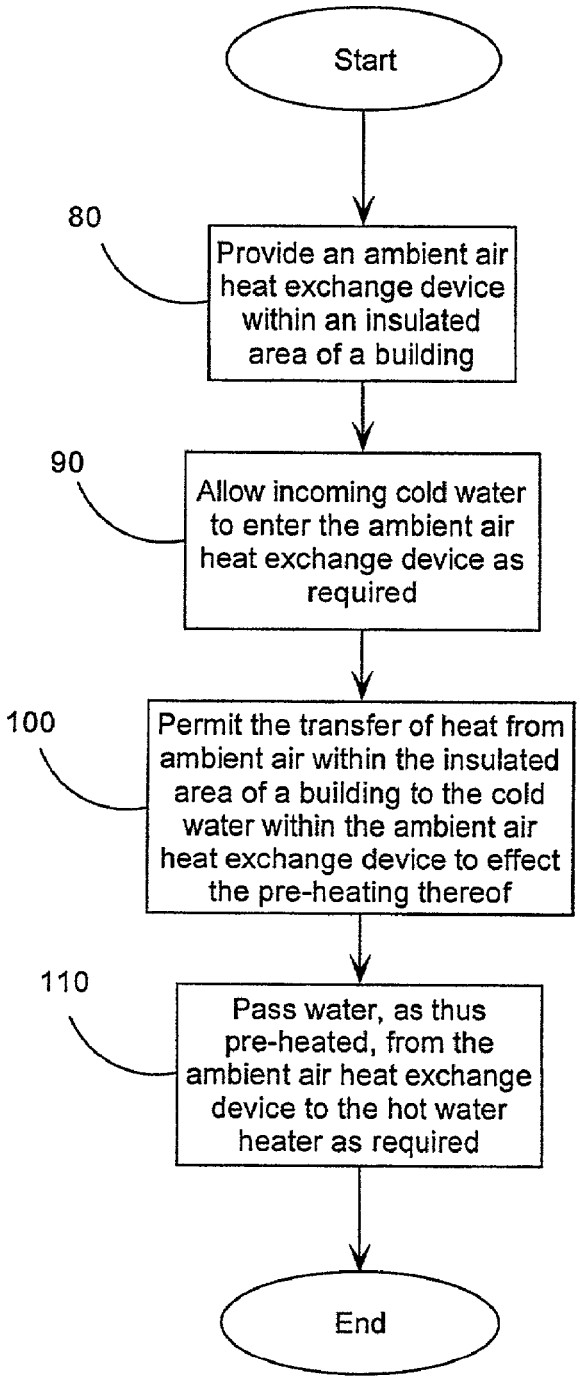
FIG. 2 presents a flow chart of a method for pre-heating water prior to entering a hot water system in accordance with an embodiment of the present invention.

FIG. 2 presents a flowchart of a method for pre-heating water prior to entering a hot water heater in accordance with a broad embodiment of the invention. In a step (80) an ambient air heat exchange device 20 is provided within an insulated area of a building 22. In a next step (90) cold water is allowed to enter the device, as required, via the cold water supply line 30. In a next step (100) heat stored in ambient air within the insulated area 22 is permitted to transfer to the cold water within the ambient air heat exchange device to effect pre-heating thereof. At a step (110), pre-heated water from the ambient air heat exchange device is passed to the hot water heater 50, via the fluid connector 40, as required.

As will be apparent to one skilled in the art, the system and method for pre-heating described above does not necessarily increase the heating efficiency of a hot water heating system per se. This is because, unlike flue exhaust pre-heaters which utilize exhausted heat from the hot water heating process itself, the additional energy used in the present system is derived from a source outside the system, namely, ambient air within an insulated area of a building. Thus, in order to determine whether there has been an increase in efficiency, one must also consider the additional costs associated with heating the ambient air. If, however, the heated air in proximity to the ambient air heat exchange device is heated with energy that is otherwise wasted, and an increase in the cost of heating the air does not occur, an increase in efficiency will result. This increase is explained below in greater detail.

First, consider that hot water heaters are typically situated in locations where maintaining a specific ambient temperature is not critical to human comfort (eg. a basement; a boiler room; etc.). Beyond preventing frozen pipes, therefore, there is little reason to maintain a particular temperature within that room. Since this energy is effectively wasted, if this energy is used for another purpose, a reduction in the useful output of heated air remains unchanged. Thus, if one can convert that excess energy into a useful form (eg. heated water), one can increase the overall efficiency of heating one's building (i.e. heating water and air). As a result of this increased efficiency, a reduction in the operating costs of one's hot water heating system can be realized.

If, on the other hand, the ambient air used to pre-heat the incoming water is not itself heated (ie. the ambient air is sufficiently heated as a result of climate), the benefits are even greater. As a result of utilizing thermal energy which occurs naturally, the pre-heating function is performed at no cost to the end user. Thus, by pre-heating the incoming cold water with this cost free energy source, one can reduce the total amount of energy required to heat the water. As a result a reduction in the operating costs of an associated hot water heater can be achieved.

The present solution is further beneficial due to its simplicity. Unlike other prior art systems, implementation of the present system does not require extensive modifications to one's existing hot water heating system. One merely has to attach the pre-heater to the cold water supply line which precedes the hot water heater.

Figure 3:
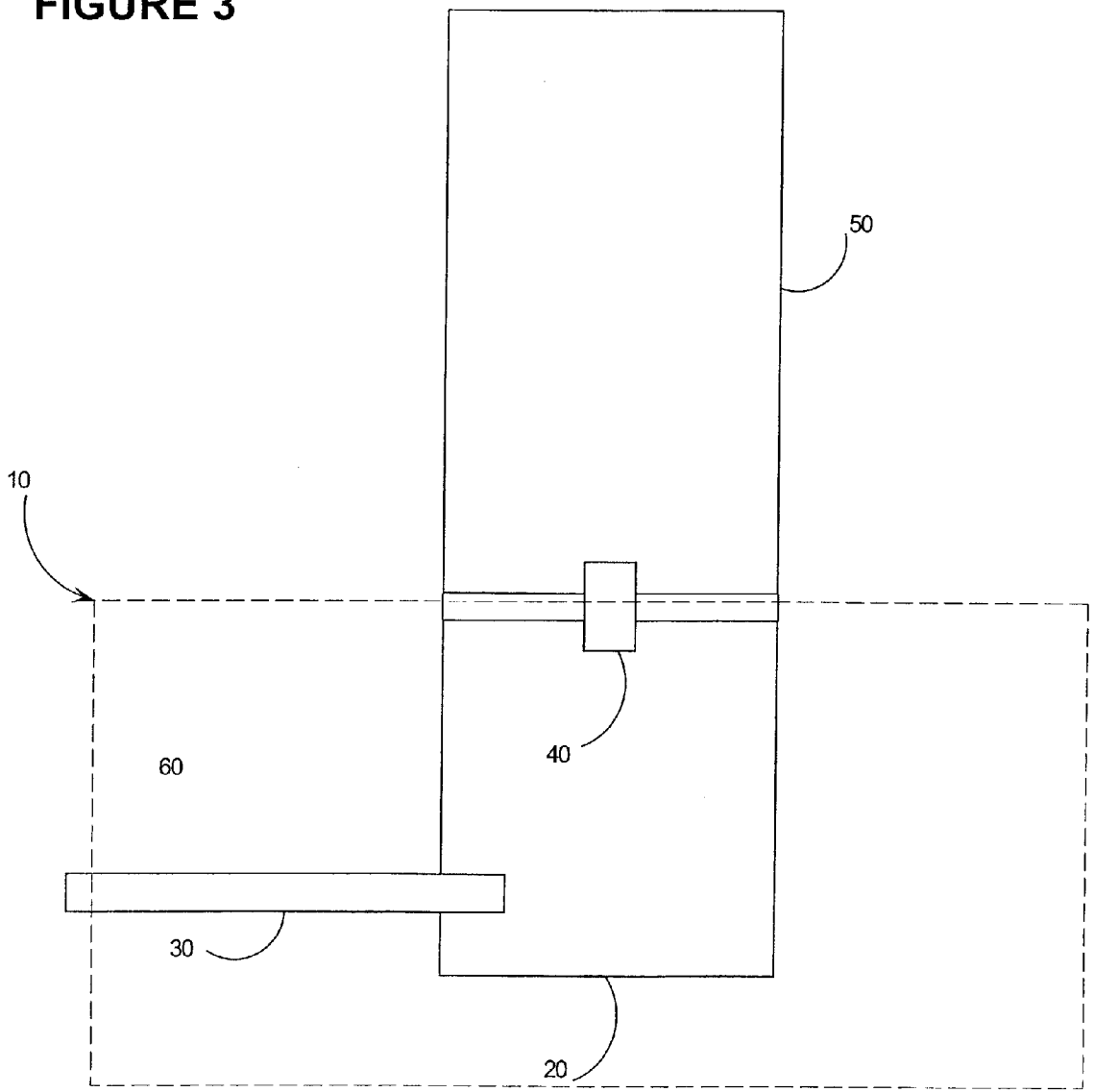
FIG. 3 presents a schematic representation of a system for pre-heating water prior to entering a hot water heater in accordance with another embodiment of the present invention.

Although in the preferred embodiment of the invention the ambient air heat exchange device 20 is shown as separate and distinct from the associated hot water tank 50, the present invention is not limited in this manner. As will be apparent to one skilled in the art, the functionality of the present invention is not dependant upon the physical separation of the heat exchange device 20 from the hot water tank 50. The present invention, therefore, would be effective if the heat exchange device 20 and hot water tank 50 were combined into one unit as shown in FIG. 3. In this alternate embodiment, the fluid connector 40 required for passing fluid from the heat exchange device 20 to the hot water tank 50 would include a port or some other appropriate fluid passage. As will be further apparent to one skilled in the art, the only requirement for implementing this embodiment is that the ambient air heat exchange device be operable to permit the heat exchange from ambient air to incoming cold water. Thus, if combining the above mentioned elements into one unit, one should ensure that, unlike the hot water heater, the heat exchange device is not heavily insulated. As mentioned previously, this is because insulation reduces the heat transfer rate of the heat exchange device and, consequently, the effectiveness of the system. The device should, however, be insulated from the hot water tank 50 itself to ensure that excessive energy does not escape the hot water tank via the ambient air heat exchange device 20.

While particular embodiments of the present invention have been shown and described, it is clear that changes and modifications may be made to such embodiments without departing from the true scope and spirit of the invention. Thus, it is intended that the present invention cover the modifications and variations of this invention provided they come within the scope of the appended claims and their equivalents.

What is claimed is:

1. A system for pre-heating water prior to entering a hot water heater comprising:

a cold water supply line;

an ambient air heat exchange device positioned within insulated boundaries of a building wherein said ambient air heat exchange device is connected to said cold water supply line, said ambient air heat exchange device having a reservoir having at least one fin; and a fluid connector for interconnecting said ambient air heat exchange device to said hot water heater, said ambient air heat exchange device being operable to:

allow incoming cold water to enter said ambient air heat exchange device as required;

permit the transfer of heat from ambient air within said insulated boundaries of a building to said cold water within said ambient air heat exchange device to effect preheating thereof; and pass water, as thus preheated, from said ambient air heat exchange device to said hot water heater as required.

2. A system for pre-heating water prior to entering a hot water heater comprising:

a cold water supply line;

an ambient air heat exchange device positioned within insulated boundaries of a building wherein said ambient air heat exchange device is connected to said cold water supply line; and a fluid connector for interconnecting said ambient air heat exchange device to said hot water heater, said ambient air heat exchange device having a baffle for preventing un-heated incoming water from reaching said fluid connector, said ambient air heat exchange device being operable to:

allow incoming cold water to enter said ambient air heat exchange device as required;

permit the transfer of heat from ambient air within said insulated boundaries of a building to said cold water within said ambient air heat exchange device to effect preheating thereof; and pass water, as thus preheated, from said ambient air heat exchange device to said hot water heater as required.

3. A method of pre-heating water prior to entering a hot water heater comprising the steps of:

providing an ambient air heat exchange device within insulated boundaries of a building, said ambient air heat exchange device having a reservoir having at least one fin;

allowing incoming cold water to enter said ambient air heat exchange device as required;

permitting the transfer of heat from ambient air within said insulated boundaries of a building to said cold water within said ambient air heat exchange device to effect preheating thereof; and passing water, as thus pre-heated, from said ambient air heat exchange device to said hot water heater as required.

4. A method of pro-heating water prior to entering a hot water heater comprising the steps of:

providing an ambient air heat exchange device within insulated boundaries of a building, said ambient air heat exchange device having a baffle;

allowing incoming cold water to enter said ambient air heat exchange device as required;

permitting the transfer of heat from ambient air within said insulated boundaries of a building to said cold water within said ambient air heat exchange device to effect preheating thereof; and passing water, as thus pre-heated, from said ambient air heat exchange device to said hot water heater as required.

5. A pro-heater for preheating water in an insulated building prior to entering a hot water heater comprising:

an ambient air heat exchange device for positioning within insulated boundaries of a building; said ambient air heat exchange device having a baffle, said ambient air heat exchange device being operable to:

allow incoming cold water to enter said ambient air heat exchange device as required;

permit the transfer of heat from ambient air within said insulated boundaries of a building to said cold water within said ambient air heat exchange device to effect preheating thereof; and pass water, as thus preheated, from said ambient air heat exchange device to a hot water heater as required.

* * * * *

UNITED STATES PATENT AND TRADEMARK OFFICE

CERTIFICATE OF CORRECTION

PATENT NO. : 7,007,742 B2
APPLICATION NO. : 10/142526
DATED : March 7, 2006
INVENTOR(S) : Desjardins It is certified that error appears in the above-identified patent and that said Letters Patent is hereby corrected as shown below:

In the claims, column 7, line 1, please delete “pro” and insert therefore - -pre- -.

In the claims, column 7, line 15, please delete “pro” and insert therefore - -pre- -.

Signed and Sealed this

Fifteenth Day of August, 2006

JON W. DUDAS
*Director of the United States Patent and Trademark Office*